US007497079B2

(12) United States Patent
Yoshida et al.

(10) Patent No.: US 7,497,079 B2
(45) Date of Patent: Mar. 3, 2009

(54) EXHAUST MANIFOLD

(75) Inventors: Takayuki Yoshida, Aichi (JP); Fuyuki Ito, Aichi (JP)

(73) Assignee: Futaba Industrial Co., Ltd, Okazaki-shi, Aichi (JP)

( * ) Notice: Subject to any disclaimer, the term of this patent is extended or adjusted under 35 U.S.C. 154(b) by 0 days.

(21) Appl. No.: 11/564,389

(22) Filed: Nov. 29, 2006

(65) Prior Publication Data

US 2007/0119158 A1 May 31, 2007

(30) Foreign Application Priority Data

Nov. 30, 2005 (JP) ..... 2005-346439

(51) Int. Cl.
*F01N 7/10* (2006.01)

(52) U.S. Cl. ..... 60/323; 60/313; 60/322; 60/324

(58) Field of Classification Search ..... 60/312, 60/313, 321–324
See application file for complete search history.

(56) References Cited

U.S. PATENT DOCUMENTS

| | | | | |
|---|---|---|---|---|
| 4,261,170 | A * | 4/1981 | Suzuki | 60/302 |
| 4,815,274 | A * | 3/1989 | Piatti | 60/313 |
| 4,939,898 | A * | 7/1990 | Ichimura et al. | 60/274 |
| 5,365,735 | A * | 11/1994 | Weber et al. | 60/323 |
| 5,784,882 | A * | 7/1998 | Bonny et al. | 60/323 |
| 5,976,473 | A * | 11/1999 | Reck et al. | 422/180 |
| 6,018,946 | A | 2/2000 | Matsumoto | |
| 6,555,070 | B1 * | 4/2003 | Kruger | 422/179 |

FOREIGN PATENT DOCUMENTS

| | | | |
|---|---|---|---|
| DE | 9205293 | * | 6/1992 |
| JP | 57140509 | | 8/1982 |
| JP | 10089064 | | 4/1998 |
| JP | 2000248930 | | 9/2000 |

OTHER PUBLICATIONS

European Search Report of Application EP06024591, EPO, May 10, 2007.

* cited by examiner

*Primary Examiner*—Thomas E Denion
*Assistant Examiner*—Diem Tran
(74) *Attorney, Agent, or Firm*—Bourque & Associates, PA

(57) ABSTRACT

An exhaust manifold is provided with a plurality of branch pipe parts and a collecting pipe part. The plurality of branch pipe parts are respectively connected to a plurality of exhaust ports of a multicylinder internal combustion engine. The collecting pipe part is formed by merging the plurality of branch pipe parts. The plurality of branch pipe parts and the collecting pipe part are formed by an upper shell member and a lower shell member superposed on each other. A partition plate is attached to at least one of the upper shell member and the lower shell member. The partition plate separates between exhaust gases flowing into the collecting pipe part from two of the branch pipe parts respectively connected to adjacent two of the plurality of exhaust ports.

23 Claims, 9 Drawing Sheets

EXHAUST MANIFOLD

CROSS-REFERENCE TO RELATED APPLICATIONS

This application claims the benefit of Japanese Patent Application No. 2005-346439 filed Nov. 30, 2005 in the Japan Patent Office, the disclosure of which is incorporated herein by reference.

FIELD OF THE INVENTION

The present invention relates to an exhaust manifold that collects and transmits exhaust air from respective exhaust ports of a multicylinder internal combustion engine to an exhaust pipe.

BACKGROUND OF THE INVENTION

A variety of exhaust manifolds have been proposed which are reduced in weight and facilitate early activation of a catalyst by controlling temperature decrease in exhaust air. For example, Unexamined Japanese Patent Publication No. 10-89064 discloses an exhaust manifold composed of three sheet metal members, that is, a front half body, a partition body and a back half body, superposed on each other. In the exhaust manifold, a second exhaust pipe and a third exhaust pipe communicated with a second exhaust port and a third exhaust port are formed between the front half body and the partition body. A first exhaust pipe and a fourth exhaust pipe communicated with a first exhaust port and a fourth exhaust port are formed between the partition body and the back half body.

Unexamined Japanese Patent Publication No. 2000-248930 discloses an exhaust manifold for use in a four cylinder internal combustion engine. The internal combustion engine has first to fourth exhaust ports. The order of exhaustion from the first to the fourth exhaust port is the first to the third to the fourth to the second. The exhaust manifold is provided with an outer case including a first branch pipe part, a second branch pipe part, a third branch pipe part, and a collecting pipe part. The collecting pipe part is formed by merging the first to third branch pipe parts. The first branch pipe part is connected to the first exhaust port, the second branch pipe part is connected to the second and third exhaust ports, and the third branch pipe part is connected to the fourth exhaust port, of the internal combustion engine. A partition pipe communicated with the second and third exhaust ports is also provided to extend from the inside of the second branch pipe part to the inside of the collecting pipe part. The partition pipe is opened inside the collecting pipe part.

SUMMARY OF THE INVENTION

However, in the former of the conventional exhaust manifolds, the front half body, the partition body, and the back half body respectively form an outer shell of the exhaust manifold. Therefore, each of the front half body, the partition body, and the back half body requires a sufficient thickness. Further reduction in weight is difficult. Moreover, the shape of the partition body is complicated. Productivity of the manifold is low since, after the front half body and the back half body are welded, the welded body has to be reversed to weld the back half body and the partition body together.

In the latter of the manifolds, the respective branch pipe parts and the collecting pipe part are formed by the outer case. However, productivity of the manifold is low due to difficulty of press molding the outer case and the partition pipe. Moreover, a tubular partition body is disposed inside the outer case which forms an outer shell. This causes increase in weight of the manifold.

One of the objects of the present invention is to provide an exhaust manifold that can improve its productivity.

In order to solve the above and other problems, the present invention provides an exhaust manifold as follows. That is, the exhaust manifold includes a plurality of branch pipe parts that are respectively connected to a plurality of exhaust ports of a multicylinder internal combustion engine, and a collecting pipe part that is formed by merging the plurality of branch pipe parts.

The plurality of branch pipe parts and the collecting pipe part may be formed by an upper shell member and a lower shell member superposed on each other.

Also, a partition plate may be attached to at least one of the upper shell member and the lower shell member. The partition plate separates between exhaust gases flowing into the collecting pipe part from two of the branch pipe parts respectively connected to adjacent two of the plurality of exhaust ports.

Each of the upper shell member, the lower shell member and the partition plate can be formed in various manners.

For example, both the upper shell member and the lower shell member may be formed by press molding a plate material.

The partition plate may be formed by press molding a plate material.

In the exhaust manifold of the present invention, the upper shell member may be formed by press molding a plate material in such a manner as to be protruded in a first direction. In this case, the lower shell member may be formed by press molding a plate material in such a manner as to be protruded in a second direction that is opposite to the first direction. Furthermore, the partition plate may be formed by press molding a plate material in such a manner as to be protruded in the first direction. Or, the partition plate may be formed by press molding a plate material in such a manner as to be protruded in the first direction and the second direction.

If the partition plate is formed by press molding a plate material in such a manner as to be protruded in the first direction, the partition plate may have a substantially semicircular cross section.

In the exhaust manifold of the present invention, the two adjacent exhaust ports may be designed to have sequential order of exhaustion.

In the present invention, the partition plate may be attached to both of the upper shell member and the lower shell member.

Also in the present invention, the partition plate may create a flow passage that merges exhaust gases flowing inside two of the branch pipe parts connected to two of the exhaust ports that have nonsequential order of exhaustion. In this case, the two exhaust ports having nonsequential order of exhaustion may be adjacent to each other. Also, the flow passage created by the partition plate has an opening inside the collecting pipe part.

In the exhaust manifold of the present invention, the partition plate may create a first flow passage that merges exhaust gases flowing inside two of the branch pipe parts connected to two of the exhaust ports having nonsequential order of exhaustion, and a second flow passage that merges exhaust gases flowing inside the other two of the branch pipe parts connected to the other two of the exhaust ports having nonsequential order of exhaustion.

In this case, the exhaust gas flowing through the first flow passage and the exhaust gas flowing through the second flow passage may be designed to be merged inside the collecting pipe part.

Alternatively, the partition plate may be designed to inhibit the exhaust gases flowing through the first flow passage and the exhaust gas flowing through the second flow passage from being merged inside the collecting pipe part.

In the exhaust manifold of the present invention, the partition plate may be designed to inhibit the exhaust gases from moving between two of the exhaust ports that have sequential order of exhaustion.

Also in the present invention, a thickness of the partition plate may be thinner than a thickness of at least one of the upper shell member and the lower shell member.

The exhaust manifold of the present invention, which includes the upper shell member and the lower shell member superposed on each other to form the plurality of branch pipe parts and the collecting pipe part, may be constituted as follows.

That is, the plurality of exhaust ports, to which the respective plurality of branch pipe parts are connected, may include a first exhaust port, a second exhaust port, a third exhaust port, and a fourth exhaust port.

In this case, the plurality of branch pipe parts may include a first branch pipe part connected to the first exhaust port, a second branch pipe part connected to the second exhaust port, a third branch pipe part connected to the third exhaust port, and a fourth branch pipe part connected to the fourth exhaust port.

Moreover, the collecting pipe part may be formed by merging the first branch pipe part, the second branch pipe part, the third branch pipe part, and the fourth branch pipe part.

In this case, a partition plate may be attached to at least one of the upper shell member and the lower shell member. The partition plate separates between an exhaust gas flowing into the collecting pipe part from the first branch pipe part and an exhaust gas flowing into the collecting pipe part from the second branch pipe part. Also, the partition plate separates between an exhaust gas flowing into the collecting pipe part from the third branch pipe part and an exhaust gas flowing into the collecting pipe part from the fourth branch pipe part.

The order of exhaustion of the respective exhaust gases from the plurality of exhaust ports may be the first to the third to the fourth to the second.

Also, the first exhaust port and the second exhaust port may be adjacent to each other, and the third exhaust port and the fourth exhaust port may he adjacent to each other.

In the exhaust manifold of the present invention, the partition plate may be arranged inside a member formed by superposing the upper shell member and the lower shell member.

The exhaust manifold of the present invention can be formed, for example, by attaching the partition plate to at least one of the upper shell member and the lower shell member and superposing the upper shell member and the lower shell member on each other. The plurality of branch pipe parts and the collecting pipe part are formed by the upper shell member and the lower shell member. Furthermore, not a partition pipe but the partition plate is used.

Accordingly, the present invention can achieve improved productivity, as compared to the exhaust manifold described in Unexamined Patent Publication No. 10-89064 including the front body, the partition body and the back half body respectively forming the outer shell of the exhaust manifold and the exhaust manifold described in Unexamined Patent Publication No. 2000-248930 including the partition pipe which is comparatively difficult to be press molded.

BRIEF DESCRIPTION OF THE DRAWINGS

The invention will now be described below, by way of example, with reference to the accompanying drawings, in which.

Figure 1:
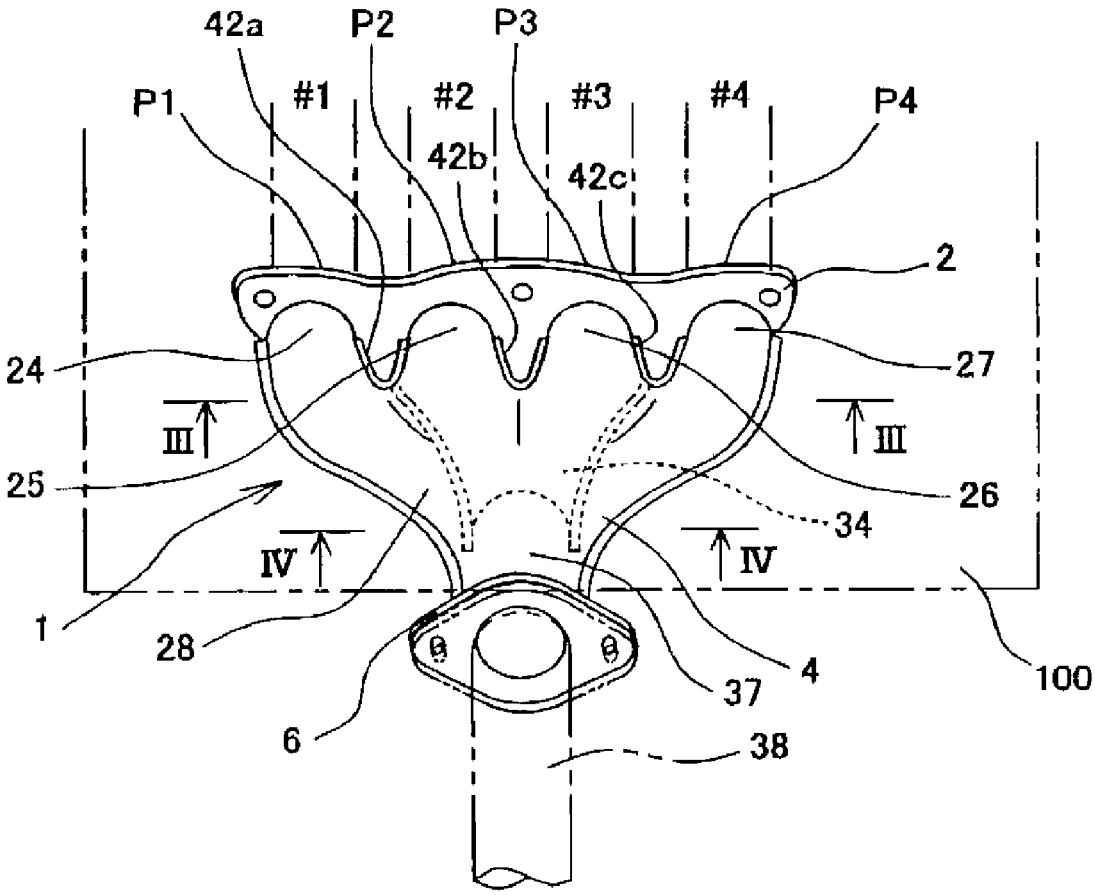
FIG. 1 is a perspective view of an exhaust manifold according to an embodiment of the present invention.
Figure 4:
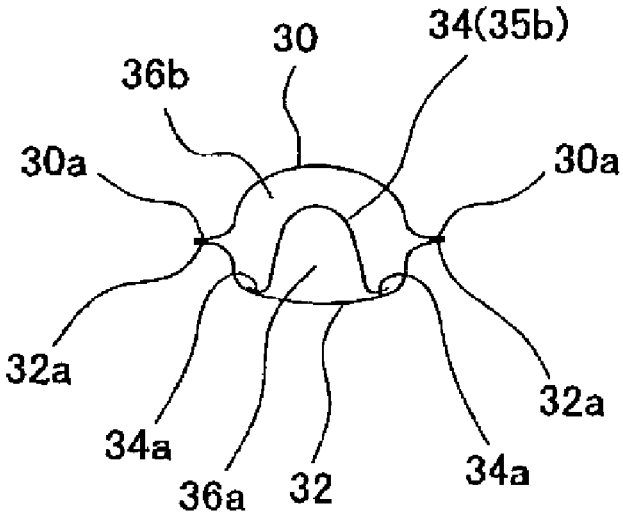
Figure 5:
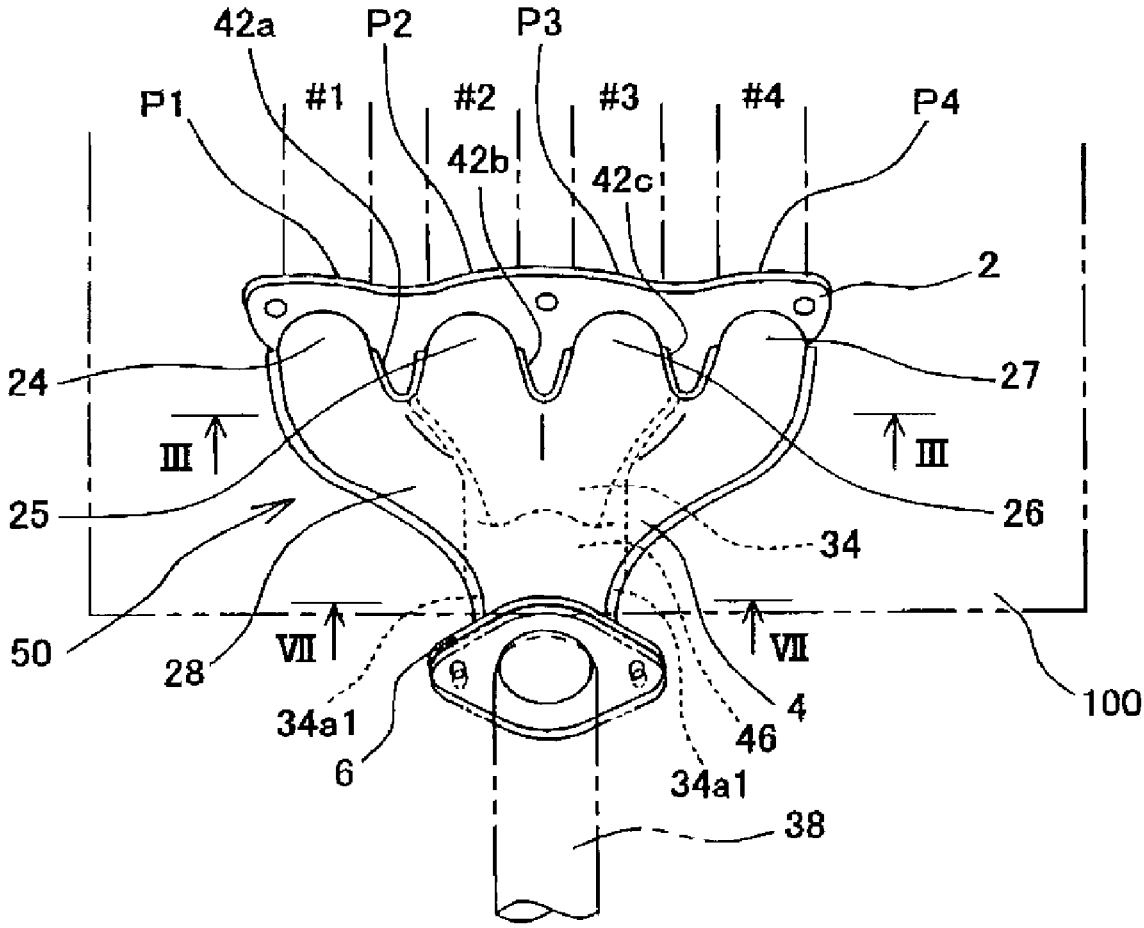
Figure 6:
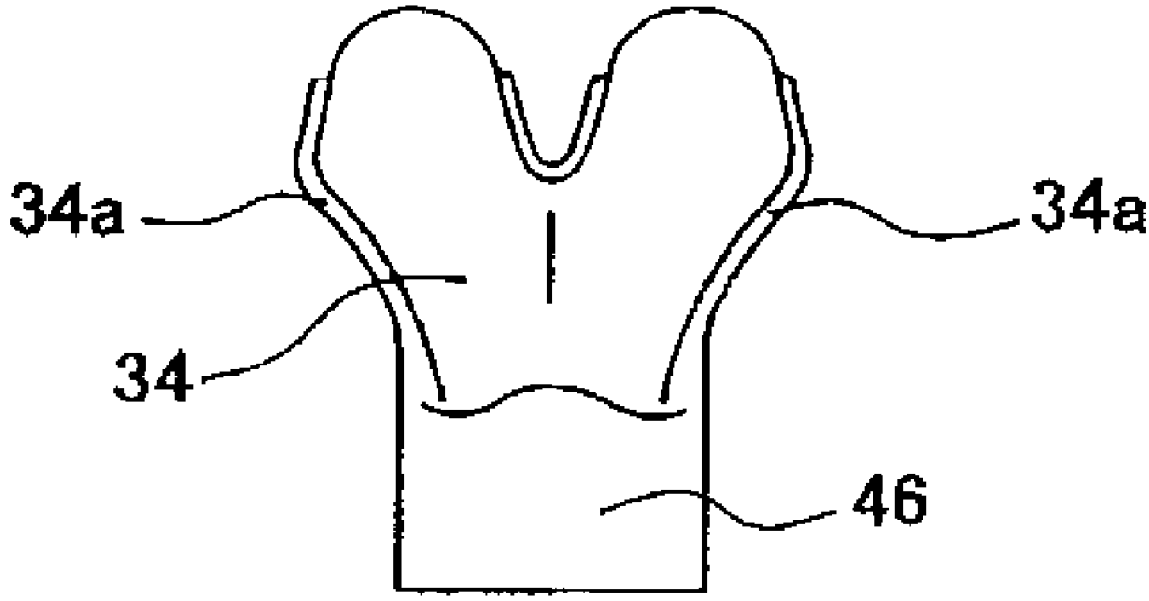
Figure 7:
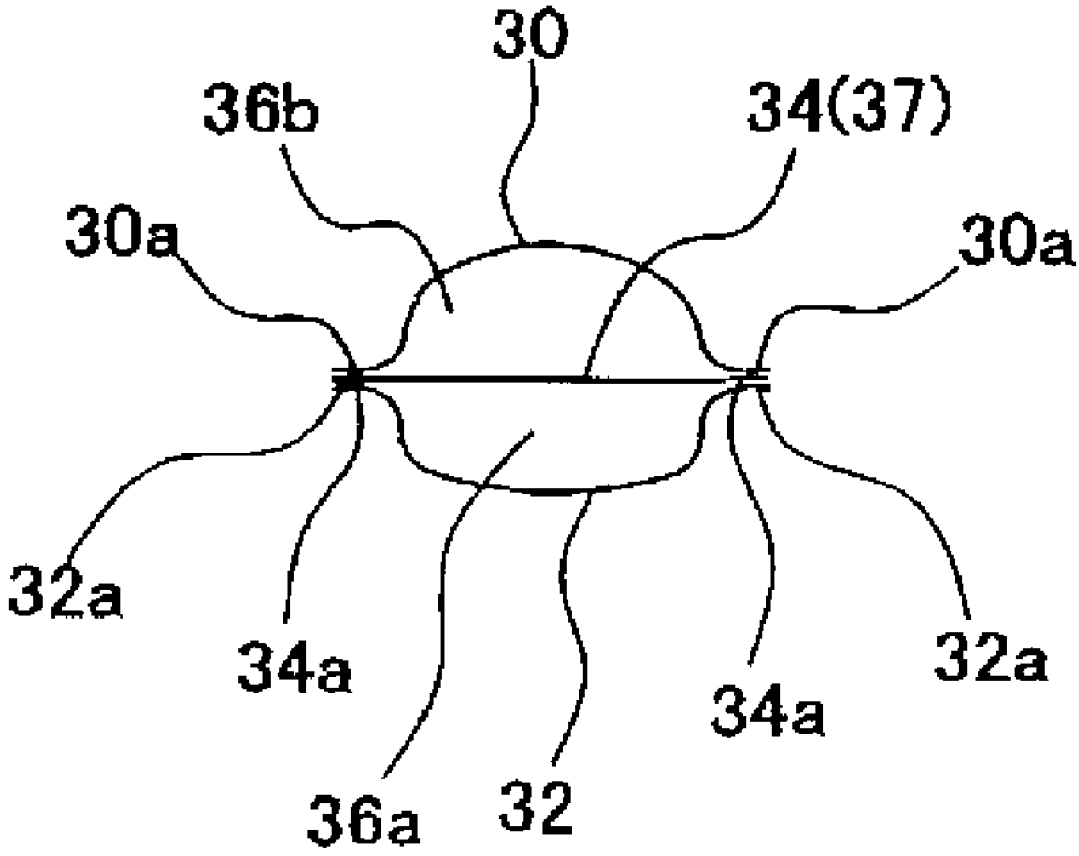
Figure 8:
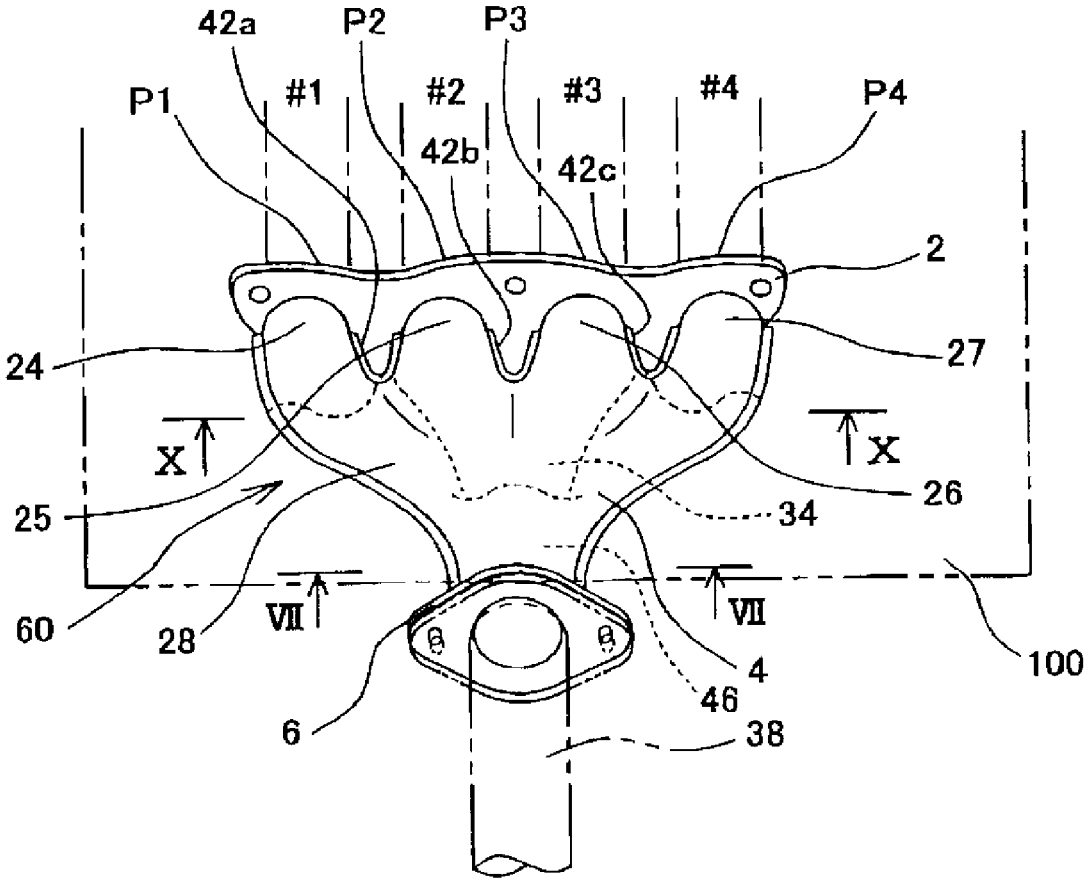
Figure 9:
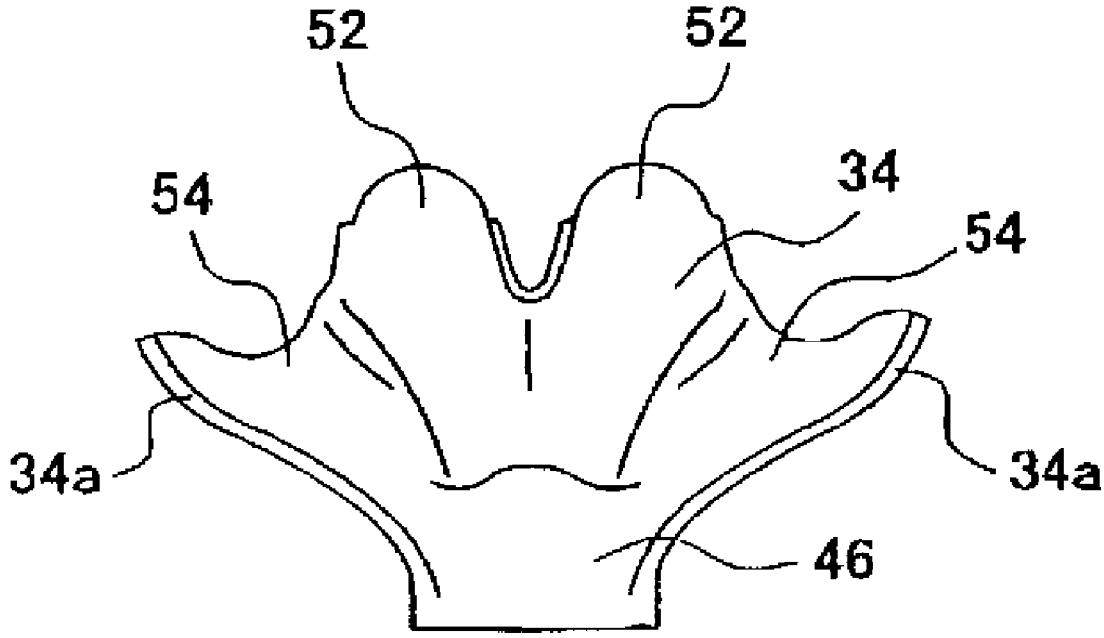
Figure 10:
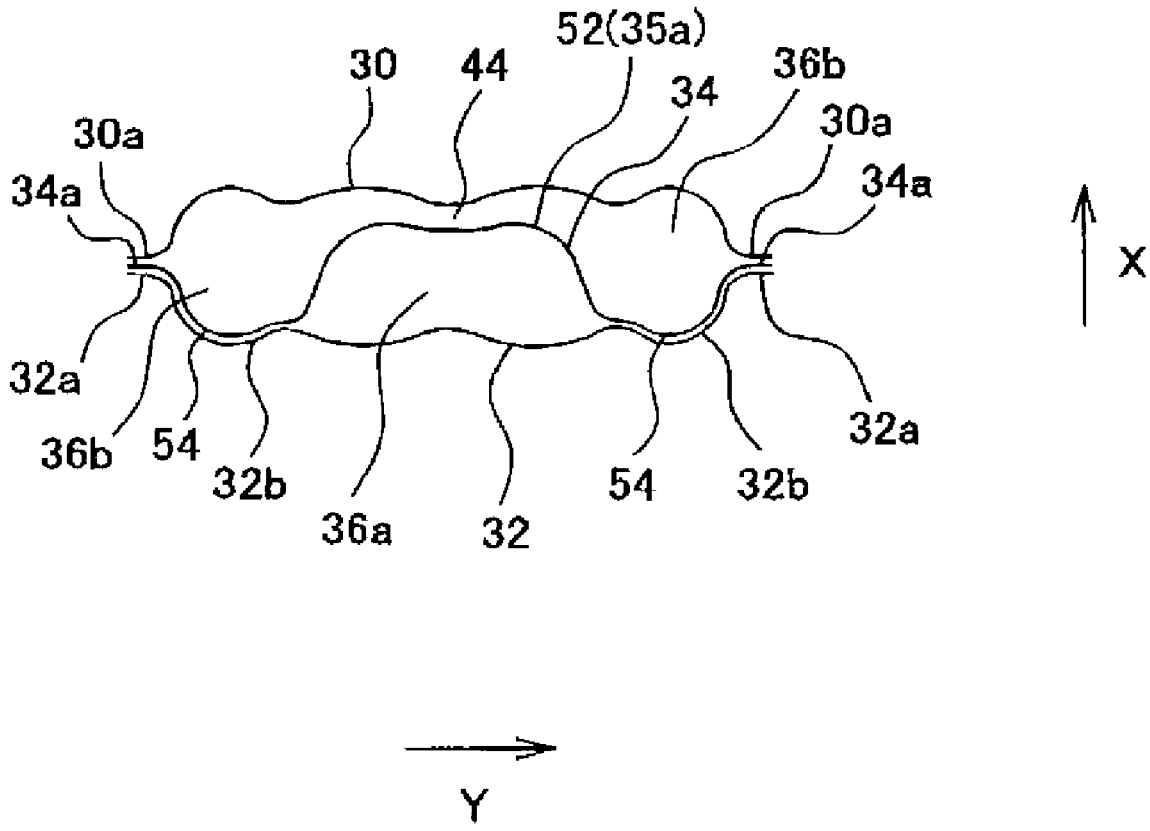

FIG, 3 is a cross sectional view taken along the line III-III in FIG. 1;

FIG. 4 is a cross sectional view taken along the line IV-IV in FIG. 1;

FIG. 5 is a perspective view of an exhaust manifold according to another embodiment;

FIG. 6 is a perspective view of a partition provided in the exhaust manifold in FIG. 5;

FIG. 7 is a cross sectional view taken along the line VII-VII in FIG. 5;

FIG. 8 is a perspective view of an exhaust manifold according to further another embodiment;

FIG. 9 is a perspective view of a partition provided in the exhaust manifold in FIG. 8; and FIG. 10 is a cross sectional view taken along the line X-X in FIG. 8.

DETAILED DESCRIPTION OF THE PREFERRED EMBODIMENTS

Referring to FIG. 1, an exhaust manifold 1 is for use in a four cylinder internal combustion engine 100 in the present embodiment. The internal combustion engine 100 is provided with first to fourth exhaust ports P1 to P4 which are respectively communicated with first to fourth cylinders #1 to #4. In the present embodiment, the order of ignition from the first to the fourth cylinder is #1 to #3 to #4 to #2.

Figure 2:
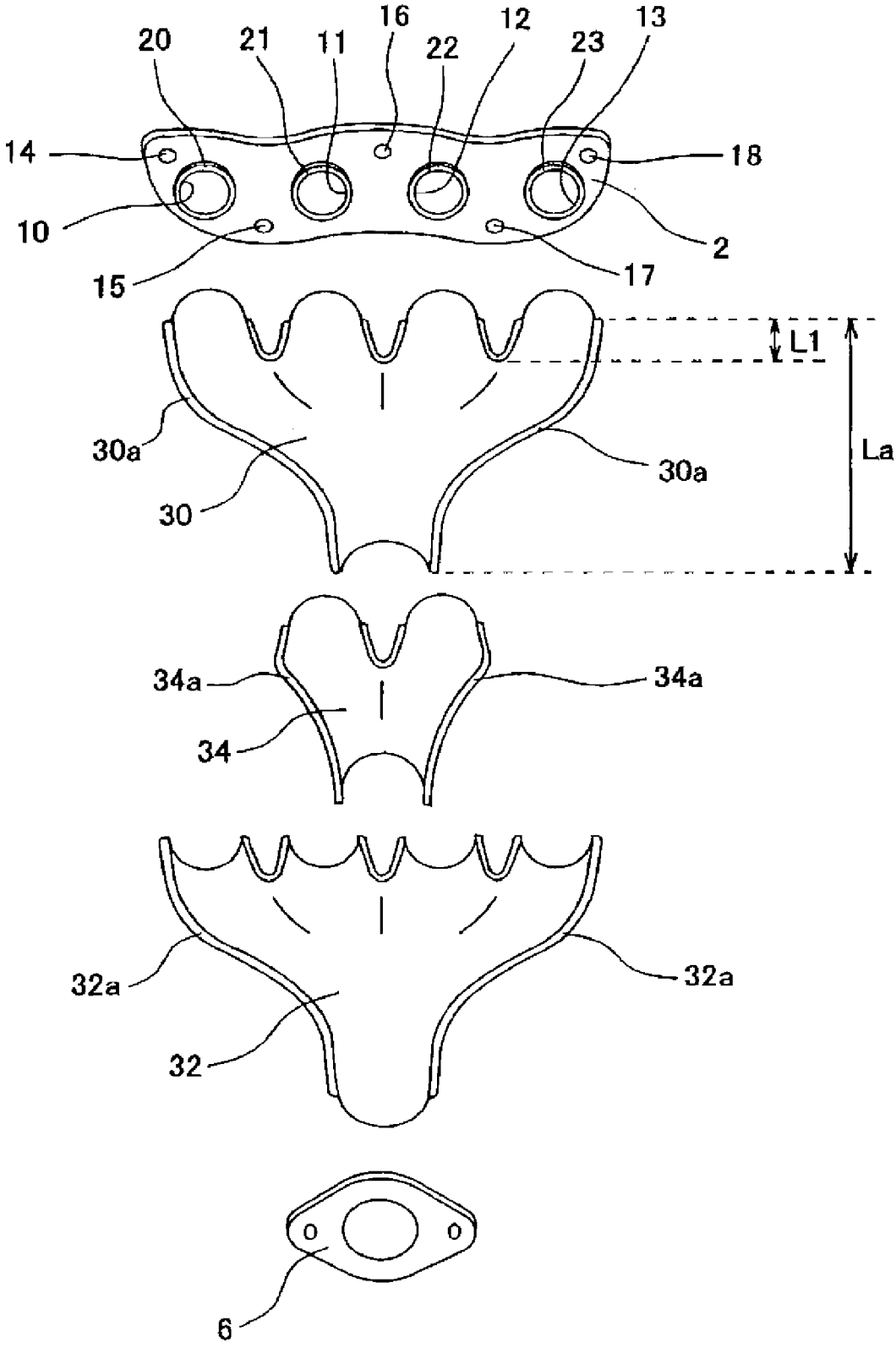
FIG. 2 is an exploded perspective view of the exhaust manifold according to the embodiment.

The exhaust manifold 1 includes a large flange 2, an outer shell member 4, and a small flange 6. As shown in FIG. 2, four through holes 10 to 13 for the corresponding first to fourth exhaust ports P1 to P4 are bored in the large flange 2. The large flange 2 is also provided with a plurality of attachment holes 14 to 18. The attachment holes 14 to 18 are used to attach the large flange 2 to the internal combustion engine 100 with not shown bolts. Annular projections 20 to 23 are respectively formed around the peripheries of the through holes 10 to 13. The annular projections 20 to 23 project to the side of the outer shell member 4.

The outer shell member 4 is provided with first to fourth branch pipe parts 24 to 27, and a collecting pipe part 28 formed by merging the first to fourth branch pipe parts 24 to 27. The outer shell member 4 is composed of an upper shell member 30 and a lower shell member 32 superposed on each other.

The upper shell member 30 and the lower shell member 32 are respectively formed by press molding a plate material.

Figure 3:
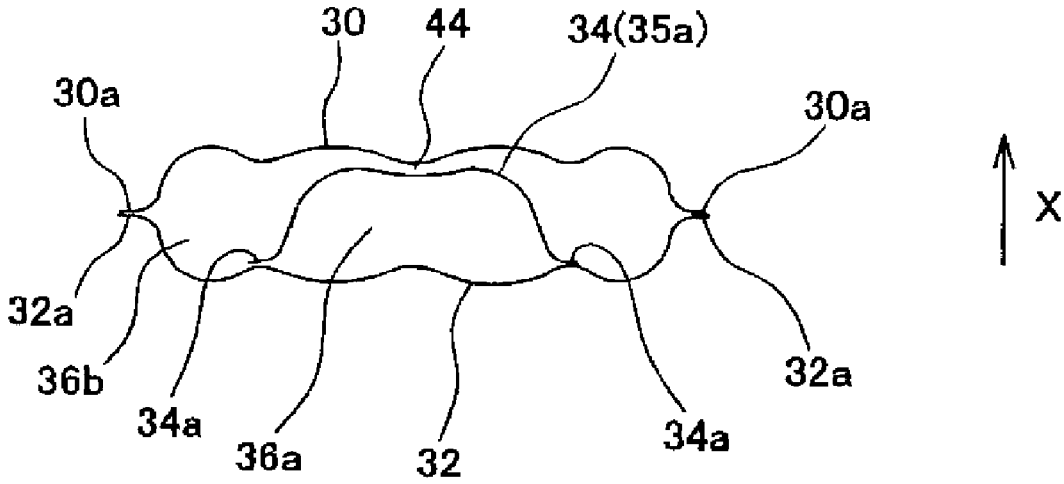

Particularly, the upper shell member 30 is formed by press molding the plate material in such a manner as to be protruded in a first direction (upward in the present embodiment, i.e., a direction of an arrow X in FIG. 3). The lower shell member 32 is formed by press molding the plate material in such a manner as to be dented (protruded) in a second direction opposite to the first direction (downward in the present embodiment, i.e., an opposite direction to the direction of the arrow X in FIG. 3). The first to fourth branch pipe parts 24 to 27 and the collecting pipe part 28 are formed by superposing the upper shell member 30 and the lower shell member 32 on each other. Since the upper shell member 30 and the lower shell member 32 can be respectively formed by extrusion in one direction (upward or downward) and have shapes that can be easily molded by press molding the plate material, productivity of the manifold 1 can be improved and low cost manufacturing can be achieved.

Except for sections where the large flange 2 and the small flange 6 are respectively to be attached, flange parts 30*a* and 32*a* are formed around respective peripheral edges of the upper shell member 30 and the lower shell member 32. The upper shell member 30 and the lower shell member 32 are designed to be superposed on and fixed to each other by welding at the flange parts 30*a* and 32*a*.

The first to fourth branch pipe parts 24 to 27 are formed into substantially cylindrical shapes by superposing the upper shell member 30 and the lower shell member 32. The first to fourth branch pipe parts 24 to 27 are designed in such a manner as to be attached to the annular projections 20 to 23 of the large flange 2.

The collecting pipe part 28 is formed by the upper shell member 30 and the lower shell member 32 superposed on each other. A relatively large internal space is formed inside the collecting pipe part 28. The insides of the first to fourth branch parts 24 to 27 are communicated with the inside of the collecting pipe part 28 so as to be merged in the collecting pipe part.

There are notches 42*a*, 42*b* and 42*c*, respectively between the first and second branch pipe parts 24 and 25, between the second and third branch pipe parts 25 and 26, and between the third and fourth branch pipe parts 26 and 27. In the present embodiment, the first to fourth branch pipe parts 24 to 27 are formed relatively short. For example, a length L1 of the first to the fourth branch pipe part 24 to 27 may be less than a half of an entire length La of the exhaust manifold 1 (see FIG. 2). The collecting pipe part 28 is formed such that its cross section area is gradually reduced toward the side of a small flange 6. The small flange 6 is attached to an opening of the collecting pipe part 28 provided on the side of the small flange 6.

A partition 34 is provided inside the outer shell member 4. The partition 34 is formed by press molding a plate material. The partition 34 is formed by press molding the plate material in such a manner as to be protruded in the first direction. The partition 34 is provided to extend from a section including the second branch pipe part 25 and the third branch pipe part 26 over to a section including the collecting pipe part 28. In the present embodiment, the partition 34 is attached to the inner wall surface of the lower shell member 32. The partition 34 may be thinner than the upper shell member 30 and the lower shell member 32.

The partition 34 is arranged to extend inside the second branch pipe part 25 and the third branch pipe part 26. As shown in FIGS. 3 and 4, the partition 34 has a cross section in the form of near upper semicircle protruding upward (direction of the arrow X in FIG. 3). As shown in FIG. 3, the partition 34 inside the collecting pipe part 28 is composed by connecting two upper semicircles respectively arranged inside the second pipe part 25 and the third branch pipe parts 26 to form one continuous upper section 35*a*. Also as shown in FIG. 4, the partition 34 has one upper section 35*b* as well. There may be a gap 44 between the partition 34 and the upper shell member 30. Alternatively, the partition 34 and the upper shell member 30 may be closely attached to each other (so that there is no gap created therebetween). The partition 34 is provided with a flange part 34*a* which contacts the inner surface of the lower shell member 32.

As shown in FIGS. 3 and 4, in the present embodiment, a first exhaust passage 36*a* is formed between the partition 34 and the lower shell member 32, by attaching the partition 34 to the lower shell member 32. The first exhaust passage 36*a* is formed by merging respective flow passages inside the second branch pipe part 25 and the third branch pipe part 26 connected to the second exhaust port P2 and the third exhaust port P3. Also, a second exhaust passage 36*b* is formed between the partition 34 and the upper shell member 30. The second exhaust passage 36*b* is formed by merging respective flow passages inside the first branch pipe part 24 and the fourth branch pipe part 27 connected to the first exhaust port P1 and the fourth exhaust port P4.

In the present embodiment, the first exhaust passage 36*a* and the second exhaust passage 36*b* respectively have an opening 37 inside the collecting pipe portion 28. That is, the first exhaust passage 36*a* and the second exhaust passage 36*b* are merged inside the collecting pipe portion 28.

Since the partition 34 has a shape that can be easily formed by press molding a plate material, high productivity and low cost manufacturing of the exhaust manifold 1 can be ensured.

In the present embodiment, the order of ignition of the first to the fourth cylinder #1 to #4 is #1 to #3 to #4 to #2. Accordingly, exhaust gases are exhausted from the first exhaust port P1, the third exhaust port P3, the fourth exhaust port P4, and the second exhaust port P2, in this order. In this case, exhaustion from the third and fourth exhaust ports P3 and P4 is sequential, and exhaustion from the first and second exhaust ports P1 and P2 are sequential. Exhaustion from the second exhaust port P2 and the third exhaust port P3 is non-sequential.

In the present embodiment, the partition 34 is disposed in such a manner that the exhaust gas from the first exhaust port P1 and the exhaust gas from the second exhaust port P2 are separated, that is, the flow passage inside the first branch pipe part 24 and the flow passage inside the second branch pipe part 25 are separated, so that interference between the exhaust gas from the first exhaust port P1 and the exhaust gas from the second exhaust port P2 is inhibited. Also, the partition 34 is disposed in such a manner that the exhaust gas from the third exhaust port P3 and the exhaust gas from the fourth exhaust port P4 are separated, that is, the flow passage inside the third branch pipe part 26 and the flow passage inside the fourth branch pipe part 27 are separated, so that interference between the exhaust gas from the third exhaust port P3 and the exhaust gas from the fourth exhaust port P4 is inhibited.

That is, in the present embodiment, migration of the exhaust gases is prevented between the two exhaust ports having the sequential order of exhaustion (between P1 and P2 or between P3 and P4) by the size and arrangement of the partition 34.

In the present embodiment, the flange part 34*a* of the partition 34 is firstly fixed to the lower shell member 32 by welding. Then, the flange part 30*a* of the upper shell member 30 and the flange part 32*a* of the lower shell member 32 are superposed to be fixed together by welding.

The partition 34 and the lower shell member 32 are put together to be welded, for example, by laser welding. Then, the upper shell member 30 and the lower shell member 32 are put together to be welded, for example, by laser welding. As above, since welding operations can be performed in the same direction and it is unnecessary to reverse the components of the exhaust manifold 1 during the series of welding operations, high productivity of the manifold 1 can be achieved.

The annular projections 20 to 23 of the large flange 2 are inserted to the first to fourth branch pipe parts 24 to 27 of the outer shell member 4. The respective peripheries of the annular projections 20 to 23 and the first to fourth branch pipe parts 24 to 27 are welded so as to secure the outer shell member 4 to the large flange 2. The small flange 6 is fixed to the collecting pipe part 28 of the outer shell member 4 by welding. A flange of a pipe provided on the downstream (e.g., exhaust pipe 38), for example, is connected to the small flange 6.

Now, operation of the above exhaust manifold 1 is explained according to the present embodiment.

The exhaust gas due to combustion in the first cylinder #1 flows from the first exhaust port P1 via the through hole 10 into the first branch pipe part 24. The exhaust gas passes the collecting pipe part 28 via the second exhaust passage 36*b* formed by the partition 34 to be transmitted to the exhaust pipe 38. Next, the exhaust gas due to combustion in the third cylinder #3 flows from the third exhaust port P3 via the through hole 12 into the third branch pipe part 26. This exhaust gas flows into the collecting pipe part 28 via the first exhaust passage 36*a* formed by the partition 34 to be transmitted from the collecting pipe part 28 to the exhaust pipe 38.

The exhaust gas due to combustion in the fourth cylinder #4 flows from the fourth exhaust port P4 via the through hole 13 into the fourth branch pipe part 27. The exhaust gas then passes the collecting pipe part 28 via the second exhaust passage 36*b* to be transmitted to the exhaust pipe 38. Here, the order of combustion in the third and fourth cylinders #3 and #4 is sequential. Also, the order of exhaustion from the third and fourth exhaust ports P3 and P4 is sequential. Furthermore, the exhaust ports P3 and P4 are adjacent to each other. However, the partition 34 favorably inhibits the exhaust gas from the third exhaust port P3 from flowing to the side of the fourth exhaust port P4. Accordingly, exhaust interference between the ports P3 and P4 can be reliably inhibited.

Next, the exhaust gas due to combustion in the second cylinder #2 flows from the second exhaust port P2 via the through hole 11 into the first exhaust passage 36*a* formed by the partition 34. The exhaust gas then flows through the inside the first exhaust passage 36*a* into the collecting pipe part 28 to be transmitted to the exhaust pipe 38. Subsequently, the aforementioned operations are repeated, and, due to combustion in the first cylinder #1, the exhaust gas flows into the first branch pipe part 24.

At that point, the order of exhaustion is sequential in the second exhaust port P2 and the first exhaust port P1. Also, the exhaust ports P1 and P2 are adjacent to each other. However, the partition 34 favorably inhibits the exhaust gas from the second exhaust port P2 from flowing to the side of the first exhaust port P1. Accordingly, exhaust interference between the ports P1 and P2 can be reliably inhibited. Thus, decrease in output torque of the internal combustion engine 100 hardly occurs.

When the internal combustion engine 100 is started, the outer shell member 4 and the partition 34 have low temperature. Heat of the exhaust gas is transferred to the outer shell member 4 and the partition 34. However, for example, if the partition 34 is made thinner than the upper shell member 30 and the lower shell member 32, heat capacity of the partition 34 can be relatively small. In this case, the temperature of the partition 34 is raised relatively quickly by the heat of the exhaust gas. As long as the aforementioned partition 34 fulfills its function, the partition 34 disposed inside the outer shell member 4 may be reduced in size or surface area, in which case the temperature of the partition 34 is raised all the more quickly by the heat of the exhaust gas. Moreover, if appropriate, the surface area of the outer shell member 4 may be reduced as much as the size or surface area of the partition 34 reduced. In this case, reduction in heat can be achieved which is radiated to the outside via the outer shell member 4.

Accordingly, the temperature of the exhaust gas passing through the exhaust manifold 1 can be restored in a short time. Temperature decrease in the exhaust gas is inhibited. Purification efficacy of the exhaust air can be improved.

In the above, one embodiment of the present invention was described. However, the present invention should not be limited to the above described embodiment, but may be practiced in various forms without departing from the gist of the present invention.

For instance, in the present embodiment, the partition 34 is attached to the lower shell member 32. However, the partition 34 may be attached to the upper shell member 30 in order to form the first exhaust passage 36*a* and the second exhaust passage 36*b*.

Also, without forming a gap 44 between the partition 34 and the upper shell member 30 as can be seen in FIG. 3, the partition 34 and the upper shell member 30 may be closely attached to be fixed together by welding, or the partition 34 and the lower shell member 32 may be fixed together by welding. Also, the partition 34 may be attached to both the upper shell member 30 and the lower shell member 34 by welding, etc.

In the above embodiment, the first exhaust passage 36*a* and the second exhaust passage 36*b* respectively have an opening 37 inside the collecting pipe part 28. That is, the first exhaust passage 36*a* and the second exhaust passage 36*b* are merged inside the collecting pipe part 28.

However, merging of the first exhaust passage 36*a* and the second exhaust passage 36*b* may be avoided inside the collecting pipe part 28.

Hereinafter, an exhaust manifold 50 is explained by way of FIGS. 5 to 7, in which merging of the first exhaust passage 36*a* and the second exhaust passage 36*b* is avoided inside the collecting pipe part 28.

As shown in FIGS. 5 and 6, the partition 34 in the exhaust manifold 50 extends to an opening on the side of the small flange 6 of the collecting pipe part 28. For this purpose, the partition 34 has a protrusion 46 that protrudes to the opening on the side of the small flange 6 of the collecting pipe part 28.

As shown in FIG. 7, due to the presence of the protrusion 46, the first exhaust passage 36*a* and the second exhaust passage 36*b* are separate even at a section near the opening on the side of the small flange 6 inside the collecting pipe part 28. Thereby, merging of the first exhaust passage 36*a* and the second exhaust passage 36*b* is avoided inside the collecting pipe part 28.

Here, a cross sectional view of the exhaust manifold 50 taken by the line III-III shown in FIG. 5 is substantially the same view shown in FIG. 3.

Also, in the exhaust manifold 50, a part 34*a*1 of the flange part 34*a* is arranged between the flange part 30*a* of the upper shell member 30 and the flange part 32*a* of the lower shell member 32 (see FIG. 5). The partition 34 is reliably secured by fixing the part 34*a*1 between the flange parts 30*a* and 32*a* by welding.

FIGS. 8 to 10 show an exhaust manifold 60 as a further another embodiment of the present invention.

In the exhaust manifold 60 shown in FIGS. 8 to 10, the partition 34 includes a first part 52 and a second part 54. The first part 52 is formed by press molding a plate member in such a manner as to protrude in the first direction. The second part 54 is formed by press molding a plate member in such a manner as to protrude in the second direction.

The second part 54 includes a part having a substantially semicircular cross section. Thereby, the second part 54 is reliably arranged along the inner wall surface of a part 32*b*, which is a part having a substantially semicircular cross section of the lower shell member 32 provided to correspond to at least one of the branch pipe parts 24 to 27 (two branch pipe parts 24 and 27 in the case of the exhaust manifold 60).

Especially in the exhaust manifold 60, the second part 54 is arranged along the inner wall surface of the part 32*b*, which is the part having a substantially semicircular cross section of the lower shell member 32 provided to correspond to the branch pipe parts 24 and 27. The branch pipe parts 24 and 27 are positioned on both ends of the plurality of (four) branch pipe parts 24 to 27 disposed along right and left direction (direction of an arrow Y in FIG. 10).

Thereby, before welding the partition 34, the partition 34 can be easily positioned at an appropriate position on the inner surface of the lower shell member 32.

In the exhaust manifold 60 as well, the partition 34 extends to an opening on the side of the small flange 6 of the collecting pipe part 28 (see FIG. 8). Also, the flange part 34*a* is arranged between the flange part 30*a* of the upper shell member 30 and the flange part 32*a* of the lower shell member 32.

Accordingly, in the exhaust manifold 60, the partition 34 and the upper shell member 30 are superposed on the lower shell member 32 to be welded at their respective flange parts 32*a*, 34*a*, and 30*a* at a time. This allows integrated fixation of all the members 32, 34, and 30, keeping an appropriate positional relationship therebetween.

A cross sectional view of the exhaust manifold 60 taken by the line VII-VII shown in FIG. 8 is substantially the same view shown in FIG. 7.

Both of the exhaust manifolds 50 and 60 respectively include the first exhaust passage 36*a* and the second exhaust passage 36*b* therein, as in the exhaust manifold 1 of the above embodiment. In the exhaust manifold 60, as in the case of the exhaust manifold 50, merging of the first exhaust passage 36*a* and the second exhaust passage 36*b* is avoided inside the collecting pipe part 28 (see FIG. 7).

Due to the presence of the partition 34, migration of exhaust gases is inhibited between two of the exhaust ports P1 to P4 which have sequential order of exhaustion (between P1 and P2 or between P3 and P4) in the exhaust manifolds 50 and 60 as in the case of the exhaust manifold 1 of the above embodiment.

What is claimed is:

1. An exhaust manifold comprising:

a plurality of branch pipe parts that are respectively connected to a plurality of exhaust ports of a multicylinder internal combustion engine, the plurality of branch pipe parts configured and arranged so as to provide at least one substantially centrally positioned branch pipe part; and a collecting pipe part that is formed by merging the plurality of branch pipe parts, wherein the plurality of branch pipe parts and the collecting pipe part are formed by an upper shell member and a lower shell member superposed on each other, wherein a partition plate is attached to at least one of the upper shell member and the lower shell member, and the partition plate separates between exhaust gases flowing into the collecting pipe part from two of the branch pipe parts respectively connected to adjacent two of the plurality of exhaust ports, and the partition plate is provided only to at least one substantially centrally positioned branch pipe part among the plurality of branch pipe parts.

2. The exhaust manifold according to claim 1 wherein the adjacent two of the plurality of exhaust ports are designed to have sequential order of exhaustion.

3. The exhaust manifold according to claim 1 wherein the partition plate is attached to both of the upper shell member and the lower shell member.

4. The exhaust manifold according to claim 1 wherein the partition plate is designed to inhibit the exhaust gases from moving between two of the exhaust ports that have sequential order of exhaustion.

5. The exhaust manifold according to claim 1 wherein the partition plate is thinner than at least one of the upper shell member and the lower shell member.

6. The exhaust manifold according to claim 1 wherein the partition plate is arranged inside a member formed by superposing the upper shell member and the lower shell member.

7. The exhaust manifold according to claim 1 wherein the upper shell member is a single upper shell member including a portion connected to each of the plurality of exhaust ports, the lower shell member is a single lower shell member including a portion connected to each of the plurality of exhaust ports, the plurality of branch pipe parts and the collecting pipe part are formed by the single upper shell member and the single lower shell member, and the single upper shell member and the single lower shell member are superposed on each other.

8. The exhaust manifold according to claim 1 wherein both the upper shell member and the lower shell member are formed by press molding a plate material.

9. The exhaust manifold according to claim 8 wherein the partition plate is formed by press molding a plate material.

10. The exhaust manifold according to claim 9 wherein the upper shell member is formed by press molding a plate material in such a manner as to be protruded in a first direction, the lower shell member is formed by press molding a plate material in such a manner as to be protruded in a second direction that is opposite to the first direction, and the partition plate is formed by press molding a plate material in such a manner as to be protruded in the first direction.

11. The exhaust manifold according to claim 10 wherein the partition plate has a substantially semicircular cross section.

12. The exhaust manifold according to claim 9 wherein the upper shell member is formed by press molding a plate material in such a manner as to be protruded in a first direction, the lower shell member is formed by press molding a plate material in such a manner as to be protruded in a second direction that is opposite to the first direction, and the partition plate is formed by press molding a plate material in such a manner as to be protruded in the first direction and the second direction.

13. The exhaust manifold according to claim 1 wherein the partition plate creates a flow passage formed by merging respective flow passages inside two of the branch pipe parts connected to two of the exhaust ports that have nonsequential order of exhaustion.

14. The exhaust manifold according to claim 13 wherein the two of the exhaust ports that have nonsequential order of exhaustion are adjacent to each other.

15. The exhaust manifold according to claim 13 wherein the flow passage created by the partition plate has an opening inside the collecting pipe part.

16. The exhaust manifold according to claim 1 wherein the partition plate creates a first flow passage that is formed by merging flow passages inside two of the branch pipe parts connected to two of the exhaust ports having nonsequential order of exhaustion; and a second flow passage that is formed by merging flow passages inside another two of the branch pipe parts connected to another two of the exhaust ports having nonsequential order of exhaustion.

17. The exhaust manifold according to claim 16 wherein the first flow passage and the second flow passage are designed to be merged inside the collecting pipe part.

18. The exhaust manifold according to claim 16 wherein the partition plate is designed to inhibit the first flow passage and the second flow passage from being merged inside the collecting pipe part.

19. An exhaust manifold comprising:

a plurality of branch pipe parts that are respectively connected to a plurality of exhaust ports of a multicylinder internal combustion engine, and the plurality of branch pipe parts configured and arranged so as to provide two substantially centrally positioned branch pipe parts; and a collecting pipe part that is formed by merging the plurality of branch pipe parts, wherein the plurality of branch pipe parts and the collecting pipe part are formed by an upper shell member and a lower shell member superposed on each other, the plurality of exhaust ports includes a first exhaust port, a second exhaust port, a third exhaust port, and a fourth exhaust port, the plurality of branch pipe parts includes a first branch pipe part connected to the first exhaust port, a second branch pipe part connected to the second exhaust port, a third branch pipe part connected to the third exhaust port, and a fourth branch pipe part connected to the fourth exhaust port, the collecting pipe part is formed by merging the first branch pipe part, the second branch pipe part, the third branch pipe part, and the fourth branch pipe part, wherein a partition plate is attached to at least one of the upper shell member and the lower shell member, and the partition plate separates between an exhaust gas flowing into the collecting pipe part from the first branch pipe part and an exhaust gas flowing into the collecting pipe part from the second branch pipe part, and separates between an exhaust gas flowing into the collecting pipe part from the third branch pipe part and an exhaust gas flowing into the collecting pipe part from the fourth branch pipe part, and the partition plate is covered only to the two substantially centrally positioned branch pipe parts among the plurality of branch pipe parts.

20. The exhaust manifold according to claim 19 wherein the order of exhaustion of the respective exhaust gases from the plurality of exhaust ports is the first to the third to the fourth to the second.

21. The exhaust manifold according to claim 19 wherein the first exhaust port and the second exhaust port are adjacent to each other, and the third exhaust port and the fourth exhaust port are adjacent to each other.

22. The exhaust manifold according to claim 19 the upper shell member is a single upper shell member including a portion connected to each of the plurality of exhaust ports, the lower shell member is a single lower shell member including a portion connected to each of the plurality of exhaust ports, the plurality of branch pipe parts and the collecting pipe part are formed by the single upper shell member and the single lower shell member, and the single upper shell member and the single lower shell member are superposed on each other.

23. An exhaust manifold comprising:

a plurality of branch pipe parts that are respectively connected to a plurality of exhaust ports of a multicylinder internal combustion engine, the plurality of branch pipe parts configured and arranged so as to provide at least one substantially centrally positioned branch pipe part; and a collecting pipe part that is formed by merging the plurality of branch pipe parts, wherein the plurality of branch pipe parts and the collecting pipe part are formed by an upper shell member and a lower shell member superposed on each other, wherein a partition plate is attached to at least one of the upper shell member and the lower shell member, and the partition plate separates between exhaust gases flowing into the collecting pipe part from two of the branch pipe parts respectively connected to adjacent two of the plurality of exhaust ports, wherein the partition plate is thinner than at least one of the upper shell member and the lower shell member, and the partition plate is provided only to at least one substantially centrally positioned branch pipe part among the plurality of branch pipe parts.

* * * * *